United States Patent [19]

Roche et al.

[11] 4,454,447

[45] Jun. 12, 1984

[54] DUAL FILAMENT FLUORESCENT LAMP WITH ELECTRON SHIELDING MEANS

[75] Inventors: William J. Roche, Merrimac; Ralph P. Parks, Jr., Beverly, both of Mass.

[73] Assignee: GTE Products Corporation, Stamford, Conn.

[21] Appl. No.: 415,308

[22] Filed: Sep. 7, 1982

[51] Int. Cl.[3] ..... H01J 61/10; H01J 61/42

[52] U.S. Cl. ..... 313/492; 313/613

[58] Field of Search ..... 313/492, 613, 491, 590, 313/614, 616

[56] References Cited

U.S. PATENT DOCUMENTS 2,769,112 10/1956 Heine et al. ..... 313/491 X 3,215,881 11/1965 Waymouth ..... 313/492

3,328,622 6/1967 Toomey ..... 313/491

3,504,218 3/1970 Emidy et al. ..... 313/492 X

*Primary Examiner*—Palmer C. Demeo

*Attorney, Agent, or Firm*—Thomas H. Buffton

[57] ABSTRACT

An energy saving fluorescent lamp includes an elongated envelope having an interior coating with phosphor and an ionizable fill material, hermetically sealed end walls, an operating electrode affixed inwardly of each end wall and a starting electrode spaced at a lesser distance from each end wall with an electron shielding means adjacent a portion of the starting electrode and intermediate thereto and the operating electrode whereby a reduction in long wattage use is effected.

9 Claims, 5 Drawing Figures

DUAL FILAMENT FLUORESCENT LAMP WITH ELECTRON SHIELDING MEANS

TECHNICAL FIELD

This invention relates to electron discharge devices such as fluorescent lamps and more particularly to a fluorescent lamp electrode structure design whereby lamp coil wattage is reduced.

BACKGROUND ART

Fluorescent lamps and particularly the so-called rapid-start type of fluorescent lamps are often utilized in locations where they are subjected to frequent changes in operational conditions. In other words, the fluorescent lamp is frequently turned on and off. As a result, designing a single filament which will provide both efficient and fast starting, as well as efficient and sustained operation, has typically represented compromise in an attempt to satisfy widely diverse conditions.

More specifically, starting a fluorescent lamp is best accomplished by an operating electrode which reaches operating temperature as rapidly as possible, has a low heat capacity or thermal inertia and draws enough power to produce a high operating temperature such that electron emission is effected during the rise in temperature of the electrode. On the other hand, operation of the fluorescent lamp is best accomplished by an electrode which has a relatively large electron emitting surface, a large reservoir of electron emissive material and operates at a relatively low temperature. Obviously, a single electrode or filament which attempts to fulfill both objectives is at best a compromise solution.

One known attempt to alleviate the above-mentioned undesirable compromise conditions is suggested in U.S. Pat. No. 3,215,811, entitled "Start-Run Plural Cathode Structure" assigned to the Assignee of the present application. Therein, separate starting and operating filaments are connected in parallel to a pair of electrical conductors. The starting electrode or filament is nearest the end wall of the envelope, has a light coating of emissive material and is fabricated to reach an electron emitting condition in a relatively short period of time. The operating electrode or filament further from the end wall has a heavier coating of emissive material and operates at a relatively low temperature.

Another known structure is set forth in U.S. Pat. No. 3,328,622, issued to C. L. Tommey and assigned to the Assignee of the present application. Therein, a primary electrode is coated with an electron emissive material and connected to a pair of electrical conductors formed for energizing the primary electrode. A secondary electrode surrounds the primary electrode and is also connected to a pair of electrical conductors exiting an envelope. The secondary electrode is absent electron emissive material except for that deposited thereon in response to energization of the primary electrode.

A further fluorescent lamp having a dual cathode structure is set forth in U.S. Pat. No. 3,504,218, issued to T. J. Emidy et al. Therein, a pair of electrodes is located at an angle of less than about 180 with respect to one another such that one electrode will deposit electron emissive material on the other when the one electrode is functioning. Also, one of the pair of electrodes is connected to a pair of electrical conductors while the other electrode is either short-circuited or has only one side thereof connected to an energizing source. In operation, one electrode operates until stripped of electron emissive materials, and the other electrode then becomes operational. This other electrode re-deposits electron emissive materials onto the first electrode which again is suitable for initiating conductivity of the lamp.

Although the above-mentioned dual-filament lamp sturctures have been utilized with varying degrees of success, it has been found that there are applications wherein such structures leave something to be desired, i.e., reduced lamp wattage. More specifically, it has been found that arc transfer between electrodes is dependent upon the potential differential at the emissive site of one electrode with respect to the point of arc transfer to the other electrode. For example, an AC filament voltage applied to one electrode will, depending upon the phase, exhibit a tendency not to transfer an arc to the other electrode when the voltage of the other electrode is at a lower potential. Thus, it has been found that the delay in arc transference from one electrode to the other results in a drastic reduction in operational life of the discharge lamp.

OBJECTS AND SUMMARY OF THE INVENTION

An object of the present invention is to provide an enhanced discharge lamp. Another object of the invention is to provide a discharge lamp having improved electrode capabilities for effecting rapid arc transfer between electrodes. Still another object of the invention is to provide a discharge lamp having improved starting and operating capabilities. A further object of the invention is to provide a discharge lamp with dual filaments which enhance electrode operation by improving lamp life without hindering lamp starting.

These and other objects, advantages and capabilities are achieved in one aspect of the invention by a fluorescent lamp having an elongated tubular envelope with sealed end walls, an interior covering of phosphors and a fill of ionizable material with a starting and an operating electrode affixed to each end wall wherein the operating electrode is inward of the starting electrode and an electron shielding means is disposed intermediate a portion of the starting and the operating electrodes.

BEST MODE FOR CARRYING OUT THE INVENTION

For a better understanding of the present invention together with other and further objects, advantages and capabilities thereof, reference is made to the following disclosure and appended claims in conjunction with the accompanying drawings.

Figure 1:
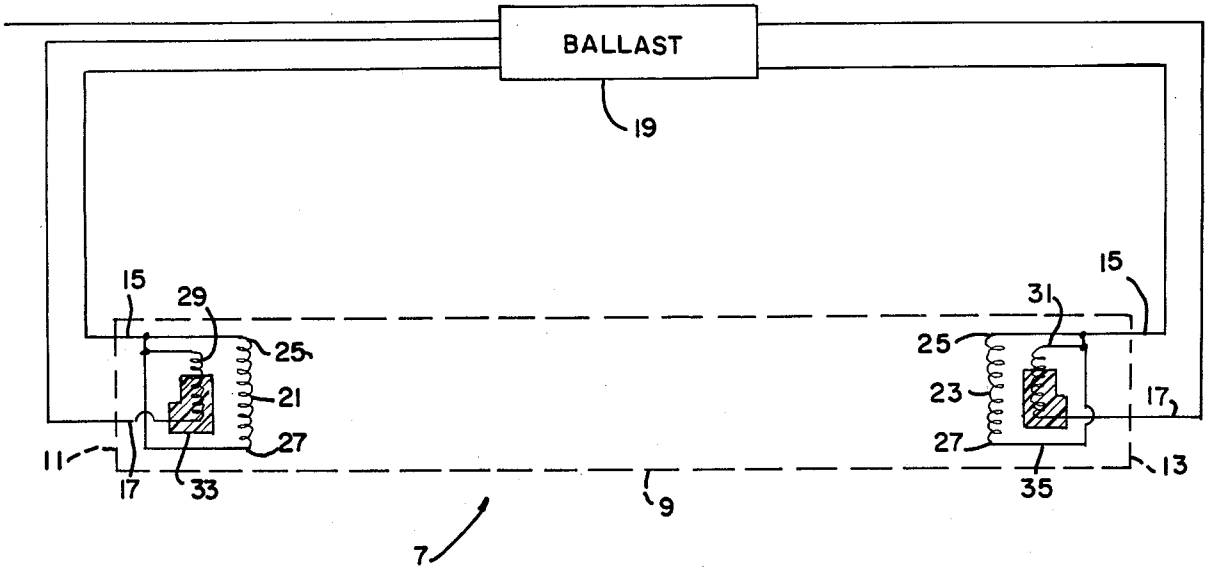
FIG. 1 is a schematic illustration of a fluorescent lamp and associated ballast apparatus including a preferred form of the invention.

Referring to FIG. 1 of the drawings, a fluorescent lamp 7 is in the form of an elongated tubular envelope 9 having a pair of end walls 11 and 13 hermetically sealed thereto. The envelope 9 has a coating of phosphors on the interior surface thereof and is filled with an ionizable gas including quantities of mercury, neon and argon, for example. A pair of electrical conductors 15 and 17 pass through each of the end walls 11 and 13 to external pin connectors (not shown) which are in turn connected to a ballast 19.

Disposed within the envelope 9 and spaced from each one of the end walls 11 and 13 is an operating electrode or filament, 21 and 23 respectively. Each one of the operating electrodes 21 and 23 has a pair of terminals 25 and 27 and at least one of the terminals 25 is connected to one of the pair of electrical conductors 15 and 17. The other one 27 of the terminal 25 and 27 may be short-circuited to the one terminal 25 or alternatively remain unattached for floating (not shown).

Disposed within the envelope 9 is a pair of starting electrodes or filaments 29 and 31. Each of the starting electrodes 29 and 31 is spaced from one of the end walls 11 and 13 at a distance less than the spacing of the operating electrodes 21 and 23. Also, each of the starting electrodes 29 and 31 is connected to the ballast 19 by way of the electrical conductors 15 and 17. Moreover, one end of each of the starting electrodes 29 and 31 is electrically connected to one of the terminals 25 of the operating electrodes 21 and 23.

Additionally, an electron shielding means 33 and 35 is adjacent a portion of each of the starting electrodes 29 and 31 and intermediate thereto and the operating electrodes 21 and 23 respectively. Preferably, the shielding means 33 and 35 is in the form of an electrical insulator coating such as zirconium dioxide ($Z_rO_2$) and covers about 50% of each of the starting electrodes 29 and 31. Alternatively, a metal shield may be disposed intermediate the starting electrodes 29 and 31 and the operating electrodes 21 and 23 to provide the desired electron shielding for at least a portion of the starting electrodes 29 and 31.

Figure 2:
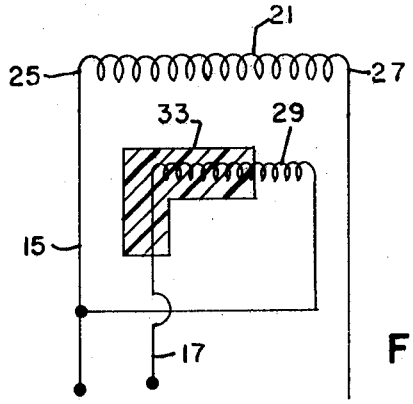
FIG. 2 is an enlarged fragmentary view of the lamp of FIG. 1.

FIG. 2 illustrates an alternative configuration wherein an operating electrode 21 has one terminal 25 connected to one electrical conductor 15 and the other terminal 27 unconnected, or floating. The starting electrode 29 is spaced from the operating electrode 21 and connected to the electrical conductors 15 and 17. Moreover, an electrical insulator 33 covers a portion of the starting electrode 29 and is positioned intermediate thereto and the operating electrode 21.

In one particular embodiment, each of the operating electrodes 21 and 23 is formed of a tugsten wire of about 9.4 mg/200 mm at a length of about 127 mm with a basket wire of 1.9 mg/200 mm and a length of 760 mm. Each of these operating electrodes 21 and 23 is of an overall length of about 13 mm with a cold resistance of about 2.1-ohms and a hot resistance of about 9.0-ohms with a current flow of about 394 ma. Also, each of the starting electrodes 29 and 31 is formed of a tungsten wire of about 2.0 mgs/200 mm, a length of about 100 mm with a basket wire of 0.97 mg/200 mm and a length of 3 conn. The resulting overall coil is 9 mm in length with a cold resistance of about 6.1-ohms and a hot resistance of about 18.7-ohms at a current flow of about 198 ma. Moreover, each of operating electrodes 21 and 23 and starting electrodes 29 and 31 has an electron emissive coating such as the well known alkaline earth oxides thereon. Additionally, each of the starting electrodes 29 and 31 has a zirconium oxide coating 33 covering about 50% thereof.

Figure 3:
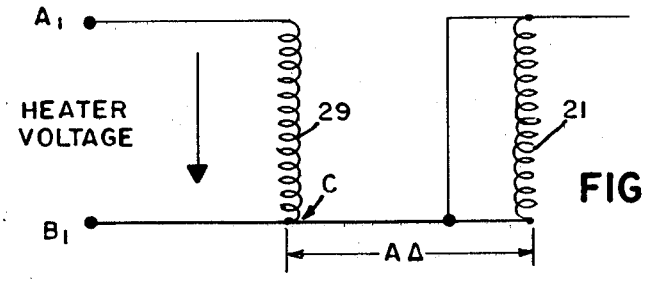
FIGS. 3, 4, and 5 are explanatory illustrations of the lamp and apparatus operation of FIG. 1.
Figure 4:
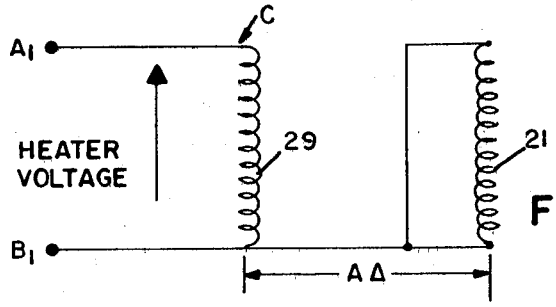
Figure 5:
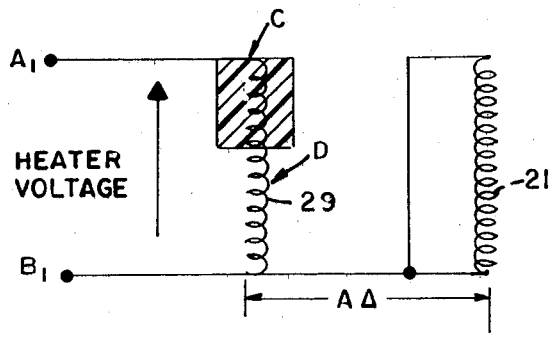

As to operation, reference is made to illustrative FIGS. 3, 4 and 5. In FIG. 3 an operating electrode 21 is positioned a distance X further into a discharge lamp than a starting electrode 29, and energy is applicable thereto by way of a pair of terminals, "A" and "B". Assume the highest potential appears at terminal "B" and that lamp ignition is facilitated by the heating of the starting electrode 29 by a 3.7-volt AC filament voltage, for example. Since the higher potential appears at "B", lamp current will establish itself in this lead and an arc will originate at the point "C" on filament 29. However, the operating electrode 21 is positioned at a distance designated X in front of or inward of the starting electrode 21 and will collect electron current on the anode half cycle of the 60 Hz current flow. Thereupon, the operating electrode 21 will heat to a thermionically emissive state, and the arc appearing at the point "C" of the starting electrode 29 will transfer to the operating electrode 21 since the operating electrode 21 represents a lower impedance path to the arc current due to its location a distance X forward of the starting electrode 29.

Under the worst operational conditions, however, it is assumed that the higher potential appears at the terminal "A", as illustrated in FIG. 2. Consequently, the lamp current will be established at a point "C" of the starting electrode 29. Again, the operating electrode 21 will intercept substantial electron current on the anode half cycle of lamp operation and will attain thermionic emission capability. However, in this instance the arc established at point "C" of the starting electrode 29 does not transfer to the operating electrode 21 since the operating electrode 21 is about 3.7 volts lower in potential than point "C" and the distance X into the discharge field is not sufficient to compensate for this lower potential. As a result of the low wattage filament desing a sustained arc at point "C" would tend to provide a catastrophic hot spot temperature which would drastically reduce the life of the discharge lamp.

However, it has been found that by coating a portion of the starting electrode 29 of FIG. 5 with an electrical insulating material 33, an arc developed at the starting electrode 29 will transfer to the operating electrode 21 even under the worst operating conditions. More specifically, again assuming the worst condition with a relatively high potential appearing at the terminal "A", an arc will now originate at a point "D" since the electrical insulating material 33 represents a non-emissive surface. Since the degree to which an arc will transfer from the starting electrode 29 to the operating electrode 21 is dependent upon the potential of the emission site, point "D", relative to the operating electrode 21 and the insulator coating 33 has moved the emission point or arc from a point "C" to a point "D", the potential at the point "D" relative to the operating electrode 21 is reduced. This reduced potential at point "D" in conjunction with the forward location by the distance X of the operating electrode 21 is effective in transferring the arc current to the operating electrode 21.

Thus, a lamp has been provided wherein a high resistance starting electrode and a relatively low resistance operating electrode are utilized to effect efficient operation. Additionally, an insulator coating utilized on the starter electrode or at least intermediate thereto and the operating electrode for effecting an efficient arc transfer. Since the starting electrode is of a high resistance and the operating coil is not supplied with heating current, it has been found that wattage dissipation is reduced. For example, it has been found that wattage dissipation in a 40-watt rapid-start lamp is reduced by 1–2 watts per lamp in accordance with the above described apparatus.

While there has been shown and described what is at present considered the preferred embodiments of the invention, it will be obvious to those skilled in the art that various changes may be made therein without departing from the invention as defined by the appended claims.

What is claimed is:

1. A fluroescent lamp comprising:

an elongated interiorly phosphor coated tubular envelope with an ionizable fill material and opposing end walls sealed to said envelope with external base pins connected to electrical conductors passing therethrough;

spaced electrode structures affixed to said end walls and including starting and operating electrodes each having an electron emmisive coating with said starting electrode connected to said electrical conductors, spaced inwardly of said end walls at a distance less than said operating electrode; and an electron shielding means adjacent to a portion of and positioned intermediate said starting and said operating electrodes whereby rapid arc transfer between electrodes is enhanced and coil wattage reduced.

2. The fluorescent lamp of claim 1 wherein said electron shielding means is in the form of an electrically conductive shield positioned intermediate said starting and operating electrode.

3. The fluorescent lamp of claim 1 wherein said electron shielding means is in the form of an electrical insulator coating covering said portion of said starting electrode.

4. The fluorescent lamp of claim 1 wherein said electron shielding means is in the form of zirconium dioxide ($Z_rO_2$).

5. The fluorescent lamp of claim 1 wherein said portion of said starting electrode having an electron shielding means is about 50% of said starting electrode.

6. A fluorescent lamp structure comprising:

an elongated tubular envelope having a phosphor coating interior surface and sealed opposing end walls;

an ionizable fill within said envelope;

a pair of base pins affixed to and passing through each of said end walls and affixed to a pair of electrical conductors within said envelope; and spaced electrode structures affixed to each of said end walls and including starting and operating electrodes with an electron emissive coating thereon, said operating electrode connected to one of said pair of electrical conductors and said starting electrode connected to said pair of electrical conductors, spaced inwardly of said end walls at a distance less than said operating electrode and;

an electron shielding means positioned intermediate a portion of said starting and said operating electrodes whereby lamp wattage is reduced.

7. The fluorescent lamp structure of claim 6 wherein said electron shielding means is positioned intermediate about 50% of said starting and operating electrodes.

8. The fluorescent lamp structure of claim 6 wherein said electron shielding means is in the form of an insulator coating covering about 50% of said starting electrode.

9. The fluorescent lamp structure of claim 6 wherein said electron shielding means is in the form of a zirconium dioxide ($Z_rO_2$) coating covering about 50% of said starting electrode.

* * * * *